US008968431B2

(12) United States Patent
Liu

(10) Patent No.: US 8,968,431 B2
(45) Date of Patent: Mar. 3, 2015

(54) METHOD AND APPARATUS FOR COOLING SOLID PARTICLES UNDER HIGH TEMPERATURE AND PRESSURE

(75) Inventor: Guohai Liu, Birmingham, AL (US)

(73) Assignee: Synthesis Energy Systems, Inc., Houston, TX (US)

( * ) Notice: Subject to any disclaimer, the term of this patent is extended or adjusted under 35 U.S.C. 154(b) by 1151 days.

(21) Appl. No.: 12/133,759

(22) Filed: Jun. 5, 2008

(65) Prior Publication Data

US 2009/0300986 A1 Dec. 10, 2009

(51) Int. Cl.

| | |
|---|---|
| ***B01J 7/00*** | (2006.01) |
| ***F23C 10/24*** | (2006.01) |
| ***C10J 3/48*** | (2006.01) |
| ***C10J 3/52*** | (2006.01) |
| ***F23J 1/00*** | (2006.01) |

(52) U.S. Cl.

CPC ..... *F23C 10/24* (2013.01); *C10J 3/482* (2013.01); *C10J 3/523* (2013.01); *F23J 1/00* (2013.01); *F23J 2900/01001* (2013.01); *F23J 2900/01002* (2013.01); *F23J 2900/01005* (2013.01); *F23J 2900/01009* (2013.01); *C10J 2300/1628* (2013.01)

USPC ..... 48/61

(58) Field of Classification Search

CPC ..... C10J 3/523; C10J 3/845; C10K 1/04; F22B 1/1846; F22B 1/18; F22B 1/1838; F22B 21/06; F22B 31/0023; F23M 5/08; F28D 2021/0075; F28D 7/0041

USPC ..... 48/61–118.5

See application file for complete search history.

(56) References Cited

U.S. PATENT DOCUMENTS

| | | | | | |
|---|---|---|---|---|---|
| 2,241,949 | A | * | 5/1941 | Griffith et al. | 122/240.1 |
| 4,153,012 | A | * | 5/1979 | Csathy et al. | 122/7 R |
| 4,270,493 | A | * | 6/1981 | Blaskowski | 122/7 R |
| 4,288,294 | A | * | 9/1981 | Velling | 201/39 |
| 4,377,072 | A | * | 3/1983 | Campbell et al. | 60/682 |
| 4,509,463 | A | * | 4/1985 | Vollhardt et al. | 122/7 R |
| 4,509,589 | A | * | 4/1985 | Carlson et al. | 165/95 |
| 4,545,330 | A | * | 10/1985 | Covell et al. | 122/392 |
| 4,627,387 | A | * | 12/1986 | Puff et al. | 122/4 D |
| 4,707,163 | A | * | 11/1987 | Gudymov et al. | 48/73 |
| 4,852,345 | A | * | 8/1989 | Greis | 60/39.464 |
| 5,209,287 | A | * | 5/1993 | Johnson et al. | 165/104.18 |
| 5,562,744 | A | * | 10/1996 | R as anen et al. | 48/197 R |
| 5,954,000 | A | * | 9/1999 | Panos | 110/165 R |
| 2003/0015150 | A1 | * | 1/2003 | Belin et al. | 122/6.6 |
| 2007/0119577 | A1 | * | 5/2007 | Kraft et al. | 165/157 |
| 2008/0011247 | A1 | * | 1/2008 | Alexander | 122/7 D |
| 2008/0282947 | A1 | * | 11/2008 | Knowles | 110/346 |
| 2008/0302511 | A1 | * | 12/2008 | Kragt et al. | 165/95 |
| 2009/0199474 | A1 | * | 8/2009 | Leininger et al. | 48/69 |

* cited by examiner

*Primary Examiner* — Imran Akram

(74) *Attorney, Agent, or Firm* — Kening Li; Miller Canfield

(57) ABSTRACT

An apparatus for cooling hot ash particles discharged from a pressurized fluidized bed reactor, comprises a vessel, a solids inlet, a plurality of cooling pipes housed inside the vessel, and a solids outlet, wherein the cooling pipes are connected to a header located outside the vessel and are arranged such that the solids can flow between the cooling pipes under gravity without being blocked by the header, and wherein cooling liquid flows from the header via a flow path through the pipes, and exchanges heat with the hot ash particles through walls of the cooling pipes. The apparatus may further comprises a computerized evaporative cooling device comprising water nozzles and a thermocouple that measures the temperature inside the vessel. Also provided is a fluidized bed reactor comprising the cooling device.

13 Claims, 7 Drawing Sheets

An example of cooling pipe arrangement

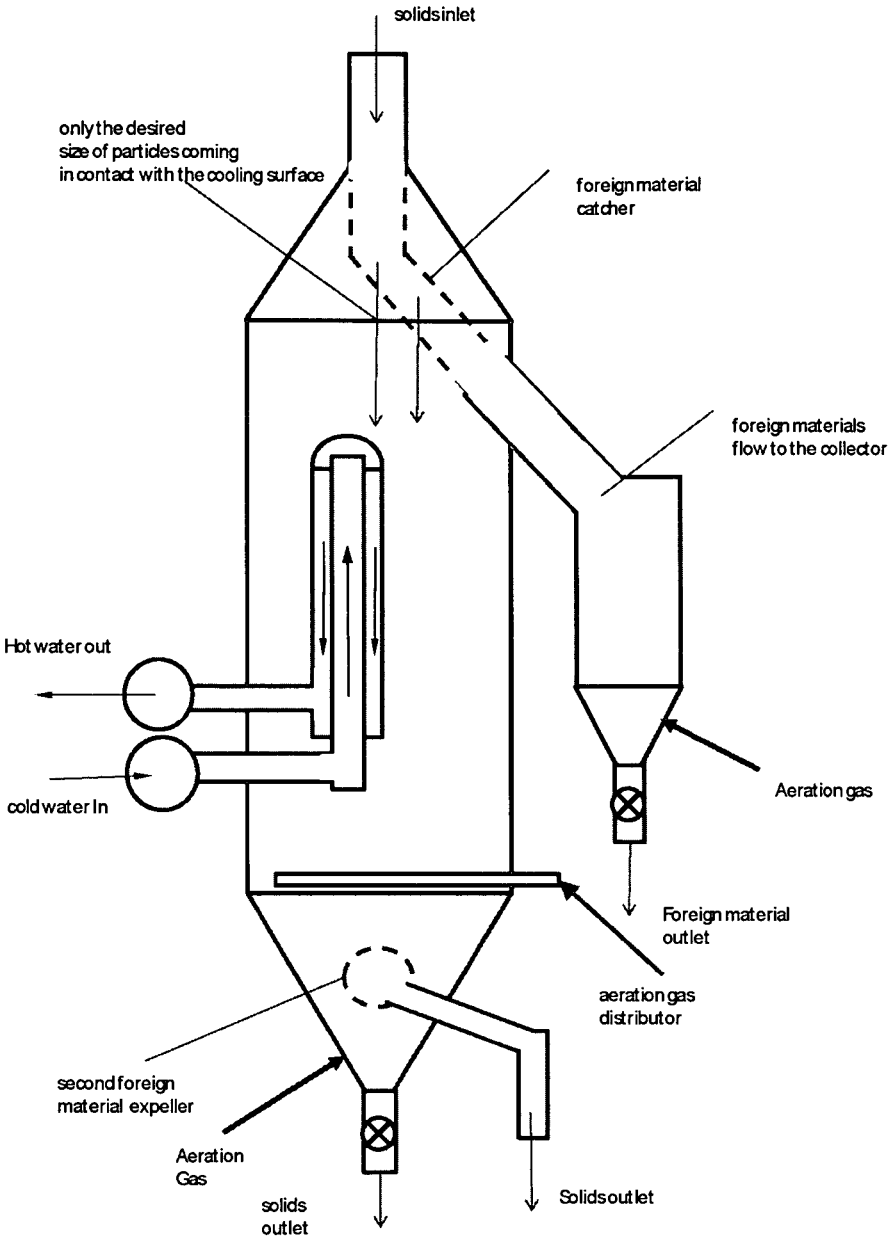
Figure 4. An example of cooling pipe arrangement

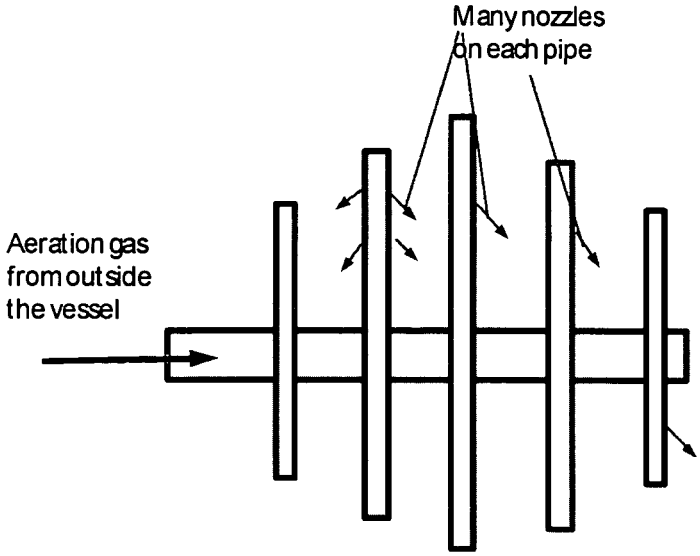
Figure 5. An example of gas distributor inside the solids cooler

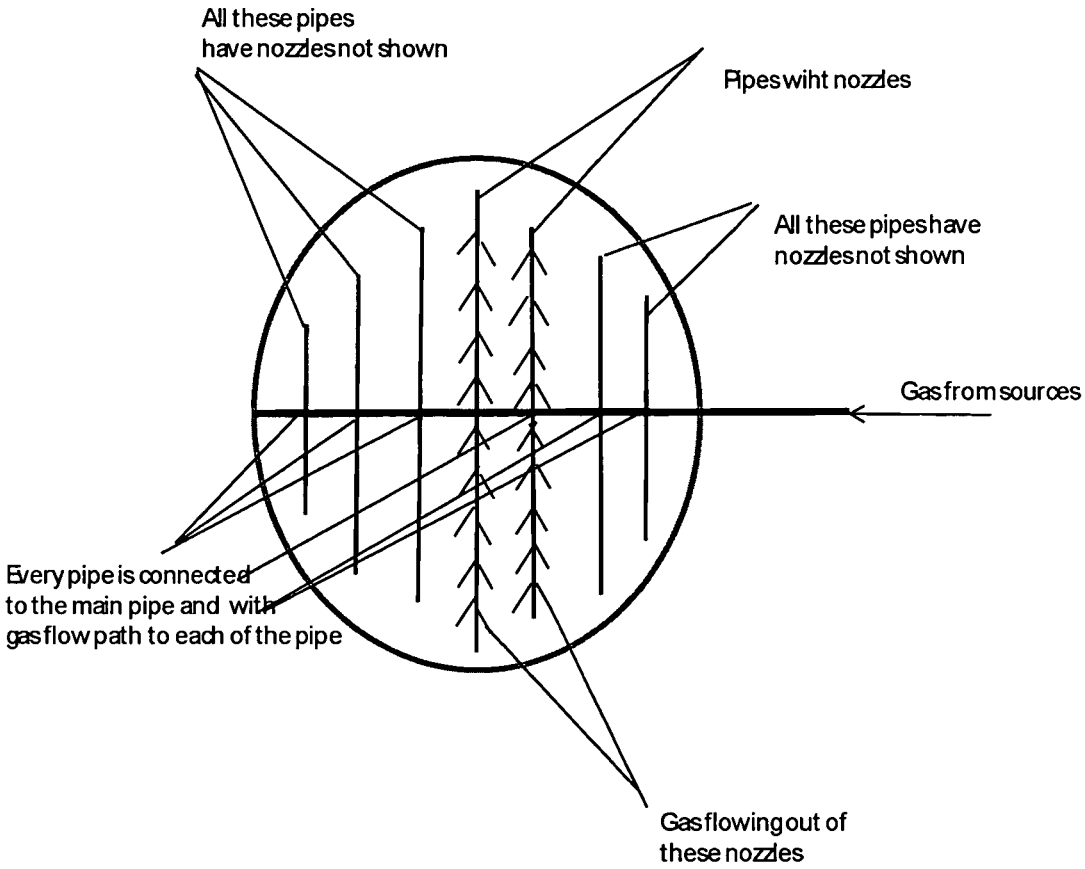
Figure 6. A top view of the gas distributor inside the cooler

METHOD AND APPARATUS FOR COOLING SOLID PARTICLES UNDER HIGH TEMPERATURE AND PRESSURE

FIELD OF THE INVENTION

The present invention is related to a method and apparatus for cooling solid particles, such as hot ash particles from a fluidized bed coal gasifier.

BACKGROUND OF THE INVENTION

Many chemical operations involve the handling of solids at high temperature and/or under high pressure. The solids often need to be cooled e.g. upon completion of the reaction for future handling or for recovery of heat. Cooling and handling of ash from a fluidized bed coal combustor and gasifier is an example.

A common device used for ash cooling is a screw cooler, in which hot ash enters the screw from one end and is pushed forward by the screw to the other. In the process, the ash in the cooler contacts and exchanges heat with the cooler surface including the shell and the screw causing the ash to be cooled.

The screw cooler, however, has been plagued at least by two problems. One is that, because the screw is operated under high pressure and temperature, the gas-solids leak through the shaft of the screw. In spite of great efforts made to prevent the screw from leaking, nearly every screw cooler develops some leaking during operations. The leaked gas-solids is hazardous to both the environment and the operation personnel. The other problem is jamming of the screw, which often result in the entire operation to shutdown due to inability to remove ash from the gasifier.

Alternative solids coolers are also used. These include fluidized and moving bed cooler. For example, U.S. Pat. No. 4,509,589 discloses the use of a circulating fluidized bed cooler for solids cooling. U.S. Pat. No. 5,954,000 discloses a method of cooling ash by a fluidized bed. In addition, U.S. Pat. Nos. 5,176,089 and 5,797,334 reveal a method using a funnel-type ash discharge system, wherein the cooling is accomplished by the membrane walls and recycle gas.

These prior art systems have problems of their own. A fluidized bed cooler needs a large amount of gas to fluidize a bed of solids. For this reason, fluidized bed cooler is not suitable for applications such as coal gasification, because the gas is difficult to return to the gasifier where the both the temperature and pressure are both high.

Likewise, a moving bed cooler generally has difficulties in discharging solids from the cooler. For example, a moving bed cooler utilizes cooling pipes which in turn need some type of support, the most conventional type of which is a tube sheet. A tube sheet is a steel plate with many holes on it to weld the tube on to it to hold the pipe, in which the cooling water or other cooling medium flows. Where a tube sheet is used for the solids cooler, a substantial amount of cooler space has to be occupied by the tube sheet, see e.g. U.S. Pat. No. 5,209,287.

Due to the high operational temperature and pressure, the requirement for a solids cooler in a coal gasification process is very stringent. In general, the shell-tube type of heat exchangers are not suitable. The solids inlet temperature to the cooler from a coal gasifier can be more than 1000° C., yet the tube sheet can only operate at relatively low temperatures (e.g. the majority of carbon steel tube sheet can generally only be operated at a temperature of not more than 330° C.). Because the tube sheet is on the path of the solids flow, it is necessary yet difficult to protect the tube sheet. Although certain efforts have been made to solve the above problem, e.g. by leaving space between the tube sheet and the solids, these designs inevitably increase the cost of the solids cooler, e.g. due to the unutilized tube and vessel space.

In addition, solids from a coal gasifier often comprise large lumps of foreign materials which may cause problems for the solids cooler in the coal gasification applications, e.g. blocking the flow path between the cooling tubes and plug the solids conveying lines. The foreign materials include small pieces of clinkers and refractory materials that break out from the wall layer and mix with the solids flow.

One purpose of this invention is therefore to provide a solution to the above problems related to solids coolers.

SUMMARY OF THE INVENTION

The present invention provides an innovative solution to the problems related to existing solid coolers. Specifically, the invention uses a modified and improved moving bed or fluidized cooler to cool the ash. In one embodiment, in the moving bed cooler of the present invention foreign materials are removed before entering the cooling surface of the cooler. In another embodiment, in a fluidized bed cooler of the present invention, steam is used as the cooling medium and then enters the gasifier as the gasification agent.

As the system of the present invention has no moving parts, the potential of leaks related to the screw cooler are completely eliminated. Furthermore, since the solids flow in the cooler is under gravity and the foreign materials has been removed before reaching the cooling surface, the potential of jamming caused by the foreign materials between the cooling surface is also avoided In one embodiment, the present invention provides an apparatus for cooling hot ash particles discharged from a fluidized bed reactor, wherein the ash particles are under pressure, the apparatus comprising a vessel, a solids inlet, a plurality of cooling pipes housed inside the vessel, and a solids outlet, wherein the cooling pipes are connected to a header located outside the vessel and are arranged such that the solids can flow between the cooling pipes under gravity without being blocked by the header, and wherein cooling liquid flows from the header via a flow path through the pipes, and exchanges heat with the hot ash particles through walls of the cooling pipes.

In one embodiment, the apparatus of the present invention further comprises at least one aeration nozzle inside the vessel to facilitate ash particle flow.

In another embodiment, the apparatus of the present invention may further comprise a foreign material catcher connected to a foreign material collector, wherein the foreign material catcher removes materials larger than a first predetermined size from the ash particles before the ash particles get in contact with the cooling pipe walls.

The solids outlet may preferably comprise a lock vessel. In a further embodiment, the solids outlet comprises a foreign material expeller, wherein the foreign material expeller removes ash particle congregates having a size larger than a second predetermined size. The solids outlet may further comprise at least one aeration nozzle that facilitates movement of the ash particles along the outlet.

In yet another embodiment, the apparatus of the present invention further comprises an evaporative cooling device, which comprises at least one water nozzle out of which water droplets are sprayed into the vessel, and a thermocouple that measures the temperature inside the vessel, wherein the amount of water droplets sprayed into the vessel is controlled such that the temperature inside the vessel is not lower than 180° C.

In one embodiment, the cooling pipe for the apparatus of the present invention comprises an inner pipe and an outer pipe connected via an annular region between the inner pipe and the outer pipe, wherein the cooling liquid from outside of the vessel flows through an inlet of the outer pipe via the annular region and then the inner pipe before exits the vessel. The inlet of the outer pipe may be located at the bottom of the outer pipe, and the cooling liquid flows upwards in the outer pipe and then downward in the inner pipe. Similarly, the inlet of the outer pipe may be located at the top of the outer pipe, and the cooling liquid flows downwards in the outer pipe and then upward in the inner pipe.

Alternatively, the cooling pipe may comprise an inner pipe and an outer pipe connected via an annular region between the inner pipe and the outer pipe, wherein the cooling liquid from outside of the vessel flows through an inlet of the inner pipe via the annular region and then the outer pipe before exits the vessel. The inlet of the outer pipe may be located at the bottom of the inner pipe, and the cooling liquid flows upwards in the inner pipe and then downward in the outer pipe. Similarly, the inlet of the outer pipe may be located at the top of the inner pipe, and the cooling liquid flows downwards in the inner pipe and then upward in the outer pipe.

The present invention further provides a fluidized bed reactor comprising an ash cooling device of as described herein. The fluidized bed reactor according to the present invention is a coal gasifier.

Other merits about the cooler become obvious in the following section after disclosure of the details.

BRIEF DESCRIPTION OF THE DRAWINGS

FIG. 4 is diagram showing different arrangement of the cooling surface of the present invention.

FIG. 5 is an example of the gas distributor inside the solids cooler.

FIG. 6 is a top-down view of the gas distributor inside the solids cooler

DETAILED DESCRIPTION OF THE INVENTION

The present invention provides an apparatus useful for cooling hot solids under high pressure in a chemical operation. The assembly and relative position of the solids cooler of the gasifier are given in FIG. 1.

In one embodiment, the present invention provides a system or an apparatus for cooling solid particles, wherein the system comprises 1) a vessel which is generally cylindrical in shape; 2) solids inlet; 3) a foreign material catcher; 4) a foreign material collector; 5) a cooling surface, or a means for heat exchange between the cooling media and the solids to be cooled, 6) optionally one or more aeration nozzles, and 7) an ash outlet/solids discharge.

Figure 3A:
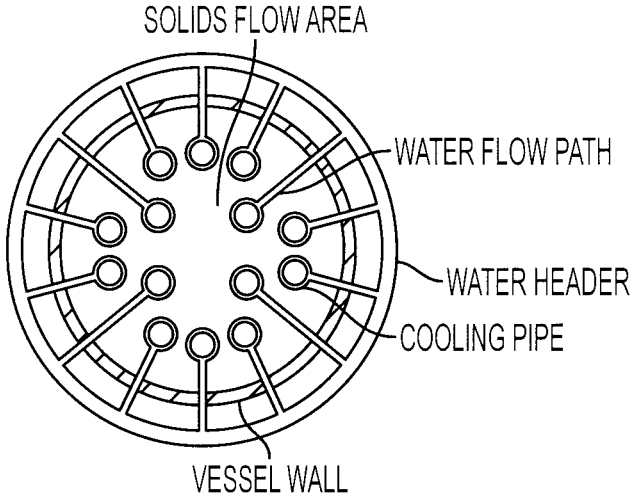
FIG. 3A is a perspective view of the solids cooler showing the positions of the water headers and the water flow paths for both liquid in- and out-flow.

Vessel The function of the vessel is to house the heat transfer surface necessary for transferring heat from the ash to the cooling medium. The vessel wall can be either lined with a refractory material to protect the metal wall or have a water jacket around the wall to cool the wall from the high temperature of the solids inside the vessel. If the vessel wall has a water jacket outside, the wall itself also serves as a cooling surface. Some aeration nozzles may also be installed on the wall to reduce the friction between the solids and the vessel wall. The vessel comprises an upper portion and a lower portion, and encloses one or more cooling pipes. At least one cooling water inlet goes through the wall and is connected to water pipes arranged vertically inside the vessel; these pipes are the cooling surface. At least one water outlet is installed to allow water to flow out of the pipe to the collection header outside the vessel. In general there are a plurality of cooling pipes connecting the vessel and the cooling pipes inside as shown in FIG. 3. The height of the vessel depends on the amount of ash cooled by the vessel. For example, the total vessel height may be about 4-8 meters for a fluidized coal gasifier.

Figure 1:
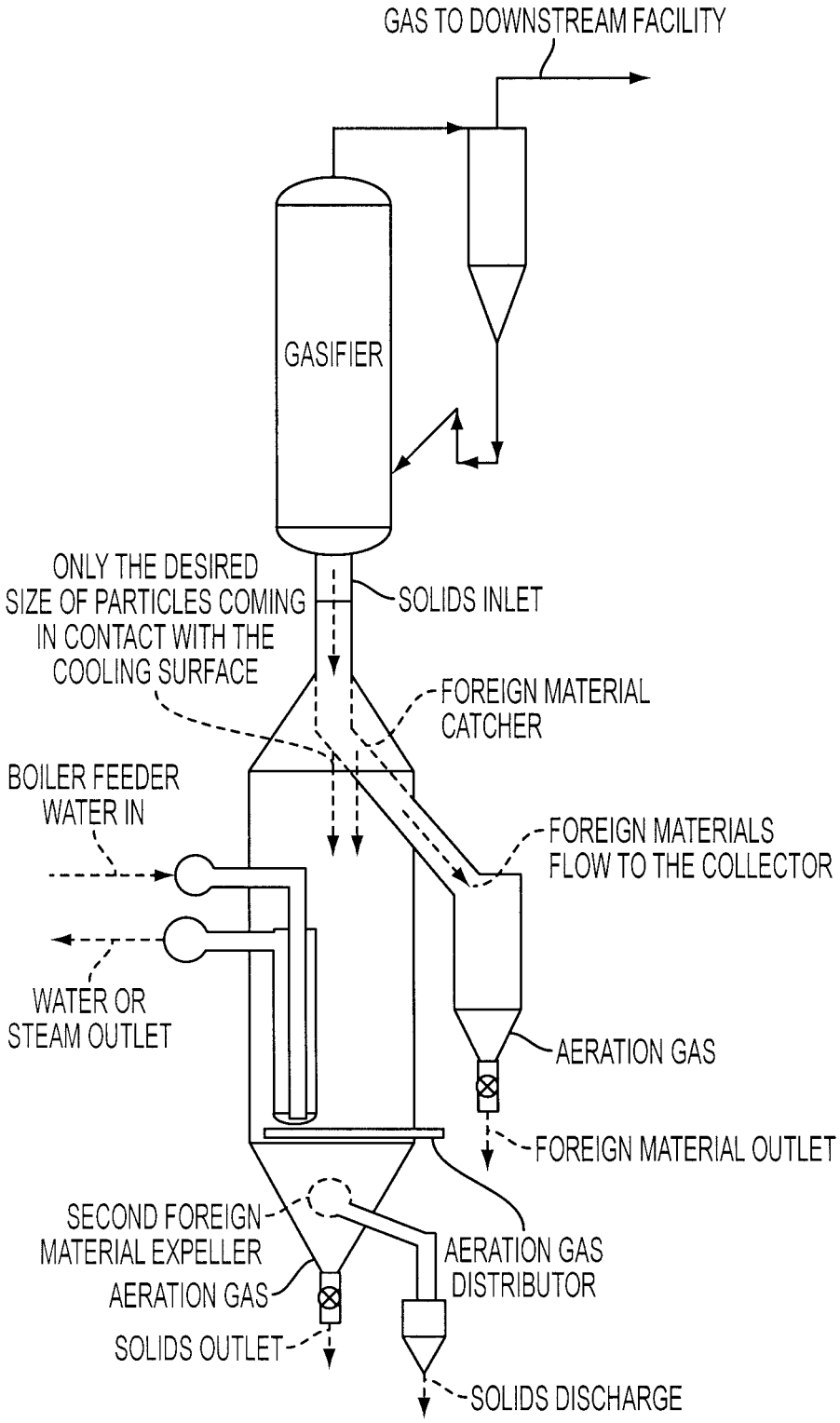
FIG. 1 is an diagram showing the assembly of an gasifier incorporating a solids cooler of the present invention.

Solids inlet In one embodiment, the solid inlet is at the top of the vessel. In an alternative embodiment, the solids inlet is at a side of the vessel. The inlet will receive ash or other solids discharged from the gasifier. As a fluidized bed gasifier has a dense bed at the bottom and a dilute phase in the top and the dilute phase is also called the free board. The solids inlet of the solid cooler of the present invention is preferably connected to a nozzle on the bottom section of the gasifier as shown in FIG. 1 beneath the dense bed region of a gasifier. The connecting nozzle withdraws the ash from the gasifier by gravity, whereby the ash enters the ash cooler from the solids inlet. The diameter of the ash nozzle depends on the ash withdrawing rate; but the minimum size of the nozzle shall be 150 mm ID or more to prevent lumps of foreign materials from blocking the nozzle.

Figure 2:
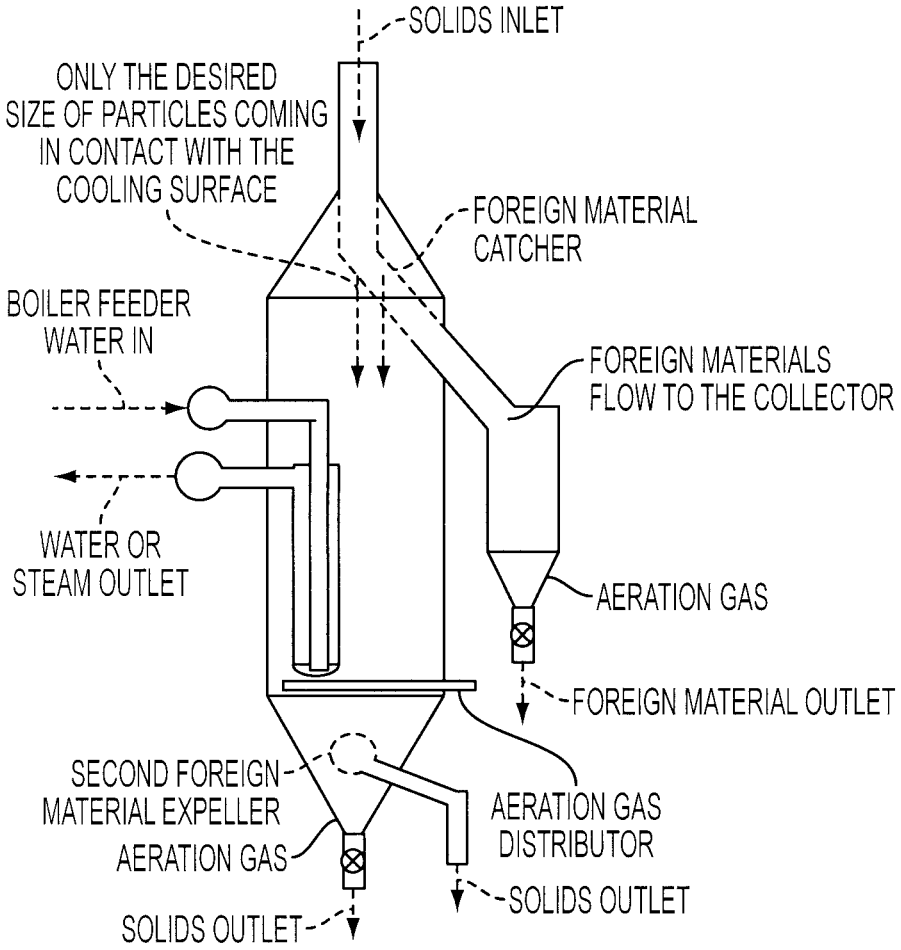
FIG. 2 is a diagram showing one embodiment of a solids cooler of the present invention.

It is a preferred arrangement to have the ash withdrawing nozzle positioned directly under the gasifier as shown in FIGS. 1 and 2. The solids cooler withdrawing ash from the gasifier bottom of the gasifier is also desirable from the gasifier operating view points. Because it is undesirable to have large foreign materials, whether a piece of clinker or refractory, that accumulate in the bottom of the gasifier, locating the ash withdrawing nozzle underneath the gasifier allows the removal of the foreign materials from the gasifier expeditiously and collected in the cooler for disposal.

Foreign material catcher is a means for removing foreign materials. The solids enter the cooler at a high temperature in the range of 400-2000° F. from the top inlet and flow through a foreign material catcher, which can be any structure that allows particles less than a desired size to pass through it but blocks any particles larger than the specified size. As described above, the foreign materials can be clinkers, pieces of falling refractory, piece of metals or melted metals. These foreign materials can be of much larger size than the ash particles. If these particles are allowed to directly contact with the cooling surface in the cooler, they may be stuck in between the cooling pipe and block the ash flow path and render some the cooling surface ineffective.

A foreign material catcher or strainer is preferably made of a cylindrical pipe with holes drilled through the pipe wall. Ash particles flowing with foreign materials can pass through the holes on the catcher to fall into the bed and then contact with the cooling surface, while foreign materials larger in size than the ash particles are retained by the catcher. The foreign materials will flow along the pipe of the catcher under gravity to a collection vessel.

Aeration gas may optionally be added to the foreign material collection vessel to facilitate movement and cooling of the large particles. Aeration gas may be $CO_2$, $N_2$ or steam. Since the aeration gas will essentially fluidize the small particles inside the foreign material catcher, the large pieces of foreign materials will sink to the lower portion of the collector. The flow rate of the aeration for the foreign material collection vessel should be higher than the minimum fluidization velocity of the normal cooling particles, but lower than the minimum fluidization velocity of the foreign materials.

Foreign material collector The solids collected by the catcher flow to another vessel, referred to as the foreign material collector, which is in communication with the cooler vessel. The foreign material collector is a cylindrical vessel with an inlet connected to the foreign material catcher and an outlet to discharge the foreign materials. In one embodiment, the foreign material collector suitable for the present invention is an elongated circular pipe perforated with holes of a desired size. The number and size of the holes depend on the application of the invention, for example they may be in the range of about 20-30 mm in diameter and up to a few hundreds of holes for the solids cooler under a fluidized bed coal gasifier. It is advantageous that during normal operation the foreign materials collected in the collector do not need to be emptied out of the collector because the gasifier, and by extension the collector, are generally under high pressure. In general this is not a problem because the amount of foreign materials is usually small for an ordinary operation period. To ensure that there is no need for solids discharging, the collector can be designed to hold reasonable amount of foreign materials, say 500 kg. However, if the foreign materials are in large amounts, a special mechanical "foreign material grinder" can be installed. The grinder crushes the foreign materials into smaller size to be discharged though a lock vessel system (see below).

Cooling surface/Heat Exchange Means The means for heat exchange between the cooling media (preferably water) and the solids to be cooled (cooling surface), in a preferred embodiment, is in the form of cooling pipes. The cooling surface or cooling pipes may possibly be arranged in many ways, but it is the intention of this invention that they be arranged such that the solids can flow between the cooling pipes without being blocked by the header of the cooling pipe. An example of the cooling surface arrangement is given in FIG. 2 through 4. For these arrangements, cold boiler feed water is added to the inner pipe through a water distribution header outside the vessel, as shown in FIG. 3, to prevent the header from blocking solids flow. Water flow to the bottom inlet inside the inner pipe and flow upwards to reach the top of the outer pipe for the case that water is flowing upwards as illustrated in FIG. 4; the distance between the upper end of the inner pipe and the top surface of the inside of the outer pipe is such that water will impinge the outer pipe to guarantee no hot spot on the outer pipe. The cooling water flows downward through the annular region of between the inner pipe and the outer pipe. The outer pipe will exchange heat with the hot solids indirectly through the outer pipe wall. The water in the annular region can be hot water or a two phase flow. In the case of the inner pipe water is flowing downward, as shown in FIG. 2, the flow direction is completely reversed to the upper flow case. In the downward flow case the cold water head will be located above the hot water header.

Figure 3B:
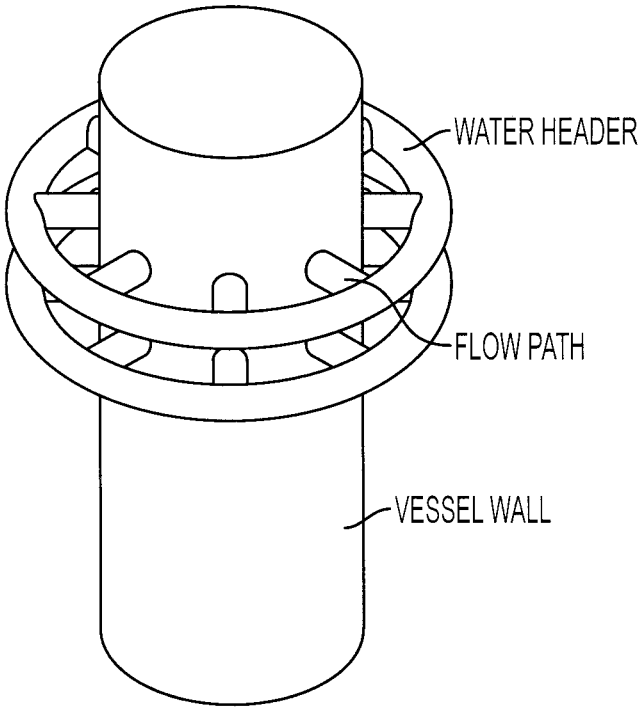
FIG. 3B is a cross sectional view of the solids cooler through one of the water heads.

There is no preference for the cooling water flow direction. However, if the cold water flows upward, it is preferred that water circulation is forced to avoid insufficient water flow to cause overheating of the outer pipe at the top tip. FIG. 3B provides an example of a cross-sectional view of a cooling pipe arrangement to show that a plurality of pipes can be arraigned in the cooling vessel without blocking overall solids flow from the top to the bottom of the vessel. As shown in FIG. 3B, many tubes can be arranged in a single vessel to accommodate the different solids flow rates from the gasifier.

Preferably, the cold water pipe is placed inside another pipe that allows hot water, or steam and water mixture, in a two-phase flow in an annular region between the inner and the outer pipe. Although FIGS. 2 and 4 shows only one cooling pipe inside the vessel, a plurality of cooling pipes are installed inside the vessel, as shown in FIG. 3, each of which has its own in- and out-flow paths. In addition, as shown in FIGS. 2 and 4, it is possible to inverse the cooling tube arrangement, where the cold water is either forced to circulate upwards or downwards through a pump and flow downward or upward in the annular region between the inner pipe and the outer pipe. Heat is transferred from the solids flowing outside the outer pipe to the fluid in the annular region. One skilled in the art will readily recognize that there are other possibilities to arrange the heat transfer pipe, as coiled pipe for example. The main advantage of the present invention is the location of the water header outside the vessel, whereby the solids flow paths is minimally blocked by the cooling pipes.

Cooled ash exits the bottom of the cooler vessel through a solids outlet (see e.g. FIG. 1. It is preferred that the ash exit temperature is below 180° C. but above the dew points of the gas that is entrained by the solids to avoid condensation on the cooling surface. The required water inlet temperature should preferably be at least 15° C. lower than the solids exit temperature. The cooling media flow rates can be calculated according to the solids flow rates and the exit temperature or the overall heat duty of the solids cooler.

Aeration nozzles, or "aeration grid" may be added to the cooler below the cooling pipes (see e.g. FIG. 1). In a preferred embodiment, the gas velocity inside the cooler is smaller than the minimum fluidization velocity but is sufficiently high to provide additional gas to the vessel to reduce the friction between the solids and the cooling surface. The addition of aeration gas will also enhance heat transfer.

In one embodiment, the present invention provides an aeration gas distributor to facilitate the provision of aeration gas inside the cooling vessel. One example of the aeration gas distributor is illustrated in FIG. 5 and a top-down view of the distributor is given in FIG. 6.

In one embodiment, the aeration gas distributor of the present invention comprises a main supply pipe, and a plurality of nozzled pipes connected to the main supply pipe. Preferably, the nozzled pipes are connected to the main supply pipe perpendicularly and in fluid communication therewith. The nozzled pipes each comprises a plurality of nozzles or small holes to distribute gas to the gas cooler. The gas velocity out of each nozzle is preferred to be greater than 25 m/s to avoid any nozzle plugging. Preferably, the nozzles or hopes are pointed downward, or otherwise away from the solids flow, to further avoid the collection of solids in the nozzle openings or holes and avoid plugging.

The aeration gas may be $CO_2$ or $N_2$ or steam for the cooler under a fluidized bed. If steam is used for the aeration gas, the steam needs to be superheated to avoid condensation; it is preferred that steam supply temperature is greater than 250° C. The supply gas pressure preferably is 3 to 5 bars above the cooler inside operating pressure to prevent the nozzle from being plugged.

For easy illustration, only one gas distributor inside the cooler is shown in the figures. It is to be understood however, the number of distributors can be as many as three or four at the different elevation of the cooler to facilitate solids flow and minimize friction.

Figure 7:
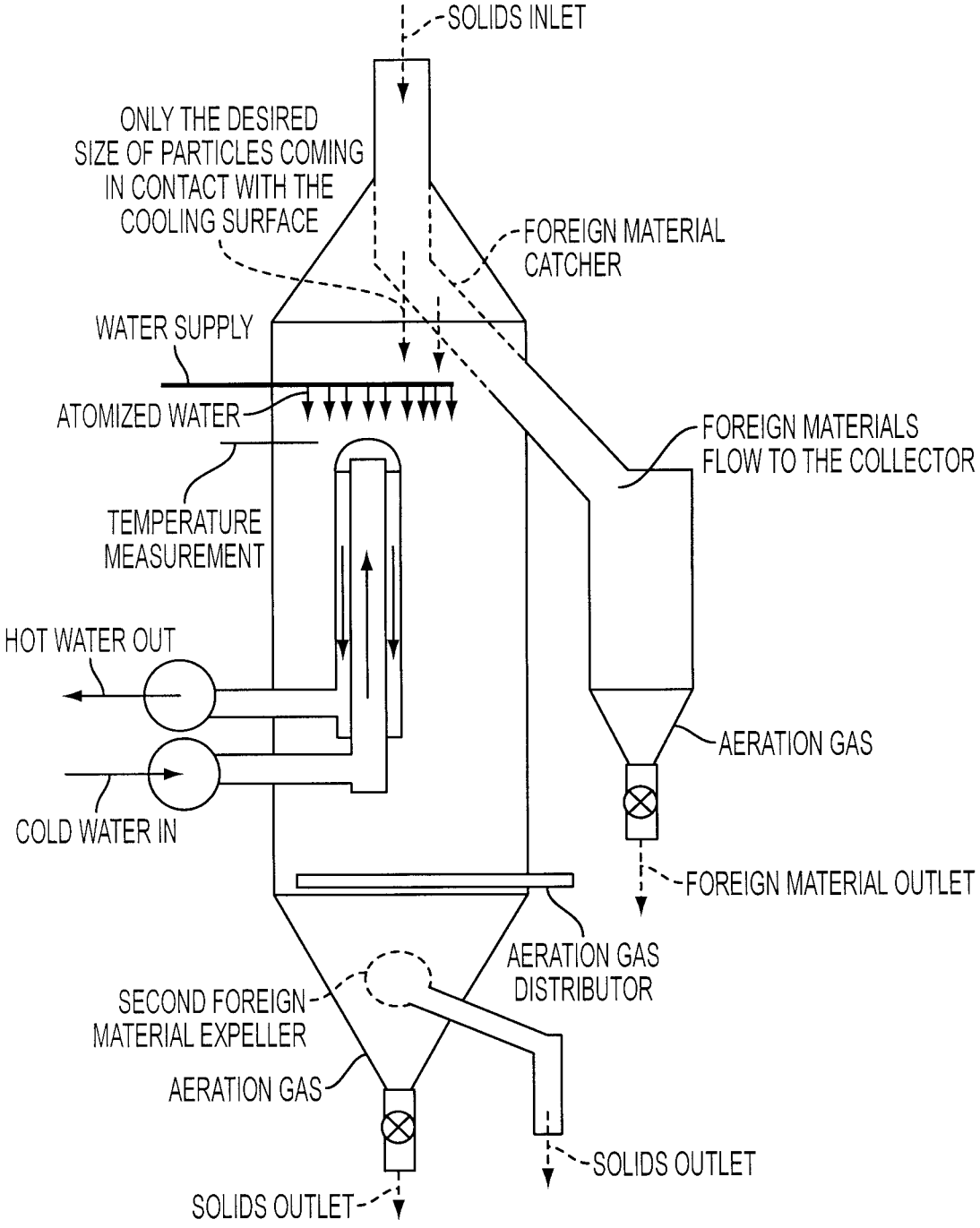
FIG. 7 is an example of the solids cooler with an evaporative cooling area.

In another embodiment of the invention, for the fluidized bed gasifier application of the cooler, atomized water can be added to the top of the cooler. When the small droplets of water out of the nozzle evaporate, evaporative cooling is effected. The location of the water spray or water nozzles in a preferred embodiment is given in FIG. 7. The advantages for evaporative cooling include that the surface area required for the solids cooler will be reduced and the steam generated can directly flow into the gasifier to be utilized as gasification agent. The heat from cooling ash can be utilized and the overall efficiency for the gasification process can be improved due to the reduction of steam importation from the outside.

If evaporative cooling is employed for the ash cooler, it is important to measure the solids temperature after the evaporative cooling. Thus preferably, at least one thermocouple will be installed for measuring the temperature of the solids at about 0.3 to 1 meters below the water spray. The temperature measurement avoids over supplying water to the cooler and liquid water accumulation in the cooler. A preferred solids temperature is about 500-650° C. after evaporative cooling. The water flow rate is calculated according to the cooling solids flow rate and the operating temperature of the gasifier.

Ash outlet/solids discharge An ash outlet or solids discharge is located at or near the bottom of the cooler vessel, through which cooled solids flow out of the cooler and can be discharged. It is preferred that the bottom of the cooler is in the shape of a circular cone. In the exit region, a foreign material expeller may be installed. The function of the expeller is to prevent large lump particles, which are smaller than the holes of the foreign material catch at the top but sufficiently big to plug the conveying line downstream of the solids outlet. The foreign materials are "expelled," or prevented from entering the solids outlet, and collected and stored at the cone section of the cooler. Under normal operational conditions, the foreign materials are sufficiently small in amount and can be kept in the cone region until the system is shutdown when the foreign materials can be discharged from the cooler through a suitable valve.

Further aeration may be added to the cone section and/or the solids exit region to facilitate the large particles segregating from the normal size particles. Additional aeration nozzles (not shown in the figure) can also be added depending on the nature of solids particles and the capacity of the cooler.

For some applications, such as a pressurized fluidized bed gasifier, the solids will be discharged into another vessel, often called lock vessel, which has an inlet valve and an outlet valve. The lock vessel receives solids in high pressure and discharge solids to another vessel at atmospheric pressure. When the lock vessel receive the solids from the cooler, the pressure of the lock vessel is the same as that in the solids cooler. When the solids level reaches a preset level in the lock vessel, the inlet valve of the lock vessel will close. The pressure of lock vessel then will be released by releasing the gas in the lock vessel. When the pressure in the lock vessel is the same as the solids conveying vessel, the outlet valve of the lock vessel will open to let the solids flow to the conveying vessel. The lock vessel is generally located above the solids conveying vessel, which is also called the feed vessel or dispense vessel. Once the solids in the lock vessel are dumped into the conveying vessel, the outlet valve of the lock vessel will close and solids will be conveyed to the silos from the conveying vessel.

An assembly of the solids cooler with a fluidized bed gasifier and with a solids discharge vessel is shown in FIG. 1.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof. Furthermore, the teachings and disclosures of all references cited herein are explicitly incorporated by reference in their entirety.

What is claimed is:

1. An apparatus for cooling hot ash particles discharged from a fluidized bed reactor, wherein the ash particles are under pressure, the apparatus comprising:

a vessel having a housing;

a solids inlet;

a plurality of cooling pipes housed inside the vessel, wherein the cooling pipe comprises an inner pipe and an outer pipe connected via an annular region between the inner pipe and the outer pipe, wherein the cooling liquid from outside of the vessel flows through an inlet of the inner pipe via the annular region and then the outer pipe before exiting the vessel, or through an inlet of the outer pipe via the annular region and then the inner pipe before exits the vessel;

a solids outlet, and a header which is located outside the housing of the vessel, is connected to a source of cooling fluid, and is connected to the cooling pipes via a flow path;

wherein the cooling pipes are connected to the header, and are arranged such that the ash particles can flow between the cooling pipes under gravity without being blocked by the header; and wherein the cooling fluid flows from the header via the flow path through the cooling pipes, and exchanges heat with the hot ash particles through walls of the cooling pipes.

2. The apparatus according to claim 1, further comprising at least one aeration nozzle inside the vessel to facilitate ash particle flow.

3. The apparatus according to claim 1, further comprising a foreign material catcher connected to a foreign material collector, wherein the foreign material catcher removes materials larger than a first predetermined size from the ash particles before the ash particles get in contact with the cooling pipe walls.

4. The apparatus according to claim 1, wherein the solids outlet comprises a lock vessel.

5. The apparatus according to claim 4, wherein the solids outlet comprises a foreign material expeller, wherein the foreign material expeller removes ash particle congregates having a size larger than a second predetermined size.

6. The apparatus according to claim 4, wherein the solids outlet further comprises at least one aeration nozzle that facilitates movement of the ash particles along the outlet.

7. The apparatus according to claim 1, further comprising an evaporative cooling device comprising at least one water nozzle out of which water droplets are sprayed into the vessel, and a thermocouple that measures the temperature inside the vessel, wherein the amount of water droplets sprayed into the vessel is controlled such that the temperature inside the vessel is not lower than 180° C.

8. The apparatus according to claim 1, wherein the cooling liquid from outside of the vessel flows through an inlet of the outer pipe via the annular region and then the inner pipe before exits the vessel.

9. The apparatus according to claim 8, wherein the inlet of the outer pipe is located at the bottom of the outer pipe, and the cooling liquid flows upwards in the outer pipe and then downward in the inner pipe.

10. The apparatus according to claim 1, wherein the cooling liquid from outside of the vessel flows through an inlet of the inner pipe via the annular region and then the outer pipe before exits the vessel.

11. The apparatus according to claim 10, wherein the inlet of the outer pipe is located at the bottom of the inner pipe, and the cooling liquid flows upwards in the inner pipe and then downward in the outer pipe.

12. A fluidized bed reactor comprising an ash cooling device according to claim 1.

13. The fluidized bed reactor according to claim 12, wherein the fluidized bed reactor is a coal gasifier.

* * * * *